United States Patent [19]

Bassani

[11] 4,286,428

[45] Sep. 1, 1981

[54] APPARATUS FOR DETWISTING TEXTILE FABRICS IN ROPE FORM

[76] Inventor: Mariano Bassani, Via Trento Trieste 7, Arcore (Milan), Italy

[21] Appl. No.: 145,650

[22] Filed: May 2, 1980

[30] Foreign Application Priority Data

May 4, 1979 [IT] Italy ..... 67934 A/79

[51] Int. Cl.[3] ..... D06C 3/06

[52] U.S. Cl. ..... 57/1 UN; 26/99; 57/31

[58] Field of Search ..... 57/1 R, 1 UN, 2.3, 2.5, 57/31; 26/1, 74, 99; 73/158, 159

[56] References Cited

U.S. PATENT DOCUMENTS

| | | | |
|---|---|---|---|
| 2,117,603 | 5/1938 | Dungler | 57/1 UN |
| 2,248,962 | 7/1941 | Cook | 57/1 UN |
| 2,759,324 | 8/1956 | Dean | 57/1 UN |
| 2,836,012 | 5/1958 | Moorhouse et al. | 57/1 UN |
| 3,533,144 | 10/1970 | Jaffe et al. | 57/1 UN X |
| 3,693,336 | 9/1972 | Bassani | 57/1 UN |
| 3,813,862 | 6/1974 | Tsuchida | 57/1 UN |
| 4,106,004 | 8/1978 | Kuroda | 57/1 UN X |

*Primary Examiner*—John Petrakes

*Attorney, Agent, or Firm*—Sughrue, Mion, Zinn, Macpeak & Seas

[57] ABSTRACT

Apparatus for untwisting a textile length which has become gathered and twisted into rope-like form includes a rotatable guide through which the textile is passed in a manner such as to be constrained for rotation therewith. The guide is rotatable by a reversible drive. Twist detecting means comprising two mutually axially-displaceable rifled rollers, are arranged to control the drive such as to rotate the guide in a sense dependent on the detected sense of twisting of the textile. To avoid the need for conventional bearings in the mounting of the guide, opposite ends of the guide are provided with respective annular tracks engaged by respective groups of rollers rotatably carried on a support structure. One of the track-engaging rollers is driven from the drive to cause rotation of the guide.

12 Claims, 4 Drawing Figures

APPARATUS FOR DETWISTING TEXTILE FABRICS IN ROPE FORM

BACKGROUND OF THE INVENTION

1. Field of the Invention

The present invention relates to apparatus for untwisting a length of textile which has become gathered together and twisted into the form of a rope.

2. Description of the Prior Art

Apparatus for untwisting a textile length coming from a treatment process (for example, dyeing) is taught in Italian patent application No. 68385-A/77 filed June 15, 1977 of which the present Applicant is co-titular. This apparatus includes a guide provided with textile entry and exit ports defining a main guiding axis. The guide is mounted for rotation about its guiding axis and carries at least one elongate element projecting transversely to and spaced from said axis. The purpose of this element is to cause a length of textile passed through the guide between its entry and exit ports to follow a sinuous path. The apparatus further includes drive means for rotating the guide, and twist-detecting means arranged to control the drive means to rotate the guide in a sense dependent on the sense of twisting of the textile. The twist detecting means is constituted by two mutually axially-displaceable rifled rollers between which the twisted textile is arranged to pass after passage through said guide. Depending on the sense of twisting of the textile, the rollers will be mutually displaced in one or other axial direction.

It is an object of the present invention to provide textile untwisting apparatus of the above form which has improved operation and reliability.

SUMMARY OF THE INVENTION

In accordance with the present invention, the guide of the untwisting apparatus is supported by rotatable-mounting means which take the form of respective annular tracks provided on said guide about said textile entry and exit, said tracks being coaxial with said guiding axis, and respective pluralities of rollers mounted on a mounting structure in correspondence with said tracks, the rollers of each said plurality being rotatable about respective axes parallel to said guiding axis, and being spaced circumferentially around the corresponding said track in contact therewith, one said roller serving as a drive roller and being drivingly coupled to said drive means.

In this manner the rotatable guide is supported without the use of anti-friction bearings, whereby the danger is avoided of the textile becoming stained in its passage through the guide by the grease which is always present in such bearings.

BRIEF DESCRIPTION OF THE DRAWINGS

Textile-untwisting apparatus embodying the invention will now be particularly described by way of non-limitative example, with reference to the accompanying drawings, in which.

DESCRIPTION OF THE PREFERRED EMBODIMENT

Figure 1:
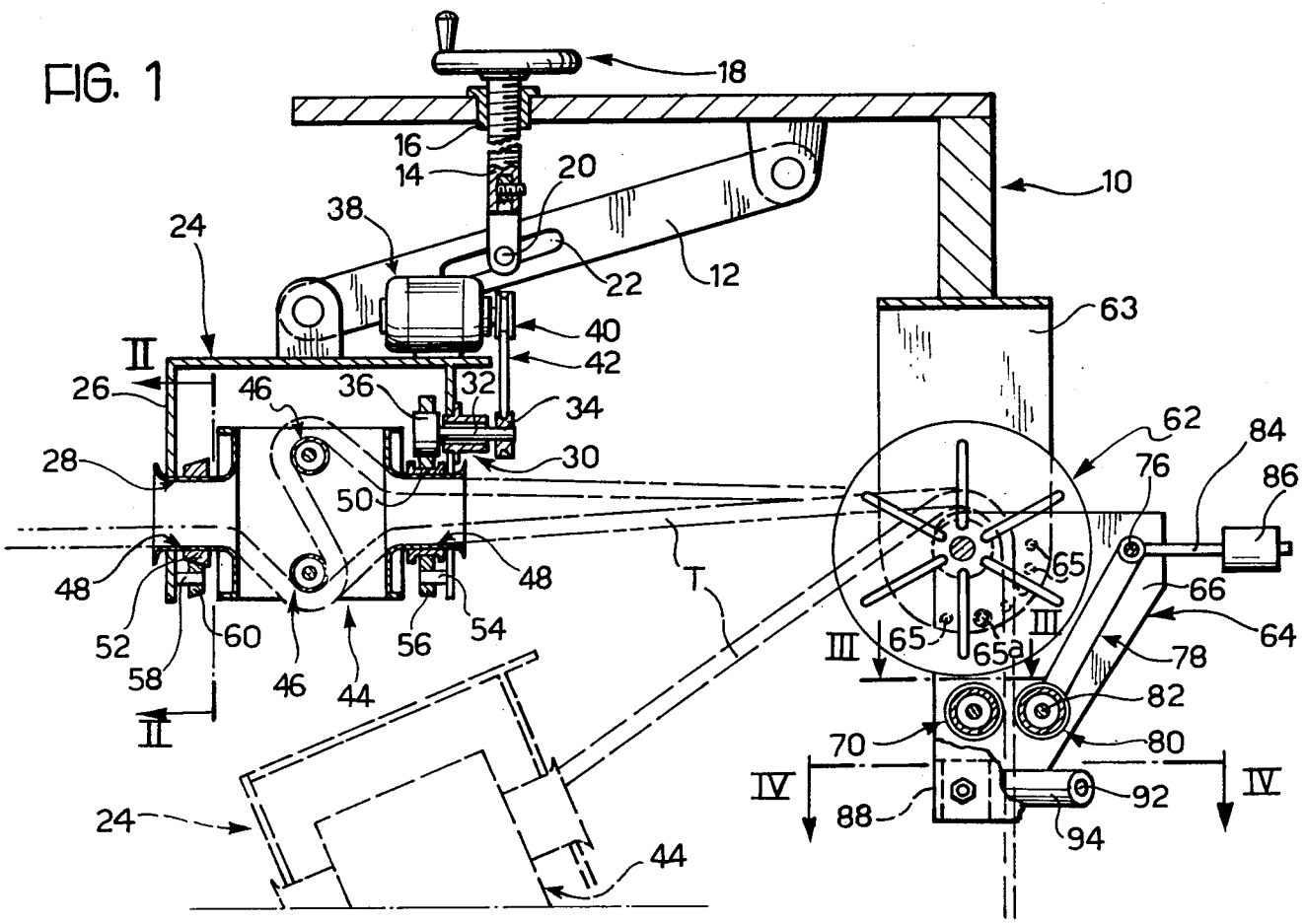
FIG. 1 is a partially-sectioned elevational view of the apparatus.

As shown in FIG. 1, the textile-untwisting apparatus comprises a fixed support structure 10 pivotally mounting a support arm 12 which is angularly displaceable by means of a lead screw 14. The lead screw 14 is engaged in a nut 16 fixed to the support structure 10 and is provided at its upper end with a control wheel 18. The lower end of the lead screw 14 carries a pin 20 which slidably engages in a slot 22 formed in the support arm 12. The arm 12 pivotally carries a mounting structure 24. This mounting structure 24 includes a casing having two opposite parallel walls 26, in each of which is formed a circular aperture 28. A support sleeve 30 is mounted in one of the walls 26 above its aperture 28. The support sleeve 30 rotatably mounts a shaft 32 which extends on both sides of the wall 26. A pulley 34 is secured to the end of the shaft 32 located outside the casing of the mounting structure 24 while the inner end of the shaft 32 fixedly mounts a roller 36. The roller 36 is coated with a material having a very high coefficient of friction. In the upper part of the support structure 24 is mounted a drive unit 38 composed of a motor-reduction unit combination. The drive unit 38 when energised is arranged to rotate a pulley 40 which transmits power to the said pulley 34 through a drive belt 42.

Figure 2:
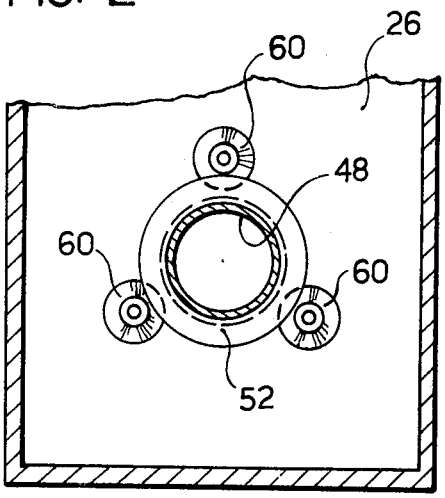
FIG. 2 is a section on line II—II of FIG. 1.

A guide 44 is housed inside the casing of the mounting structure 24 and is provided with textile entry and exit ports. The guide 44 is mounted for rotation about its axis of guiding defined between said ports. The guide 44 rotatably supports two idler rollers 46 the axes of rotation of which are equidistant from the guiding axis of the guide and which, in the orientation of the guide 44 shown in FIG. 1, are perpendicular to the guide median plane coincident with the plane of the drawings. The guide 44 is provided at both ends with coaxial tubular portions 44 which extend through the apertures 28 in the walls 26. Two bushes 50 and 52 are respectively fixed to the right- and left- hand guide end portions 48 as viewed in FIG. 1. The outer surface of the bush 50 provides a track of cylindrical form while that of the bush 52 provides a track of frusto-conical form convergent towards the outer end of the corresponding guide end portion 48. The casing wall 26 which supports the roller 36 carries two projecting pivot pins 54 (only one of which is shown in FIG. 1) on each of which is rotatably mounted an idler roller 56 made of bronze. The three rollers 36, 56 are angularly spaced from each other by 120° around the guiding axis of the guide 44, and each roller 36, 58 has an outer cylindrical wall arranged to roll on the outer surface of the adjacent bush 50. On the inner surface of the opposite casing wall 26 are fixed three pivot pins 58 (only one of which is shown in FIG. 1) on each of which is rotatably mounted a bronze idler roller 60 (see FIG. 2). The rollers 60 are equi-angularly spaced from each other around the axis of the guide 44. The outer surface of each roller 60 is of frusto-conical form convergent towards the inside of the guide 44, this outer surface being in rolling contact with the outer surface of the bush 52.

The rollers 46 of the guide 44 are carried by pivot pins which are mounted in an adjustable manner on the walls of the guide itself to allow the distance between these rollers and the axis of the guide to be varied.

Figure 3:
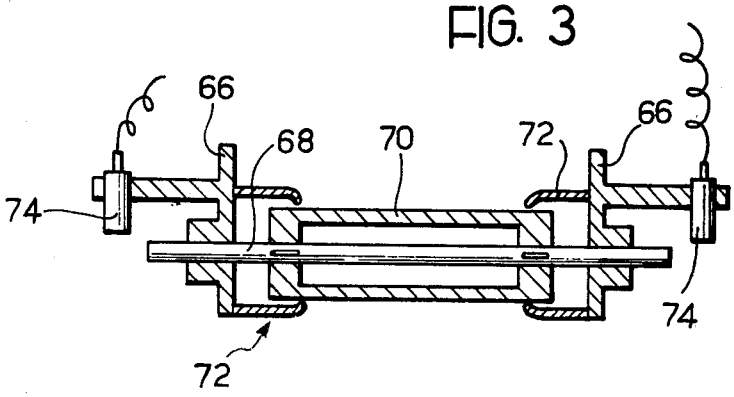
FIG. 3 is a section on line III—III of FIG. 1.

Downstream of the guide 44 the fixed support structure 10 supports a pulley 62 by means of a forked element 63. Coaxial with the pulley 62, the forked element 63 pivotally supports a roller mount 64 which can be angularly fixed in any one of a number of positions by the engagement of a pin 65*a* fixed to the roller mount 64 in any one of a series of apertures 65. The roller mount 64 has two opposite walls 66 which serves to support a pin 68 in a manner enabling its rotation and axial displacement. Secured to this pin 68 is a rifled roller 70 the ends of which are located within respective tubular sleeves 72 fixed to the walls 66. As is best seen in FIG. 3, the edges of each sleeve 72 are turned inwardly and lie close to the outer surface of the rifled roller 70. Upon the axial displacement of the pin 68 in either direction, exceeding a predetermined value, the corresponding leading end of the pin 68 is arranged to activate a respective proximity sensor 74 to produce a control signal. The sensors 74, which may, for example, be of a magnetic or photo-electric type, are fixed to the roller mount 64 and are connected to an electrical control circuit (not illustrated) arranged to control the drive unit 38 in dependence on the activation of the proximity sensors 74, the sense of rotation of the drive unit 38 being dependent on which of the two sensors 74 is activated.

A rod 78 is pivotally mounted on the wall 66 of the roller mount 64 at point 74. The rod 78 carries at its lower end a rifled roller 80 similar to the adjacent roller 70. The rifled roller 80 is mounted for idling rotation on a pivot pin 82 of the rod 78 and is not axially displaceable. The axes of rotation of the rod 78 and of the rifled rollers 70 and 80 are parallel to each other. In addition to the roller 80, the rod 78 carries a projecting arm 84 on which is mounted a counter-weight 86 in an adjustable manner. The action of this counter-weight 86 is such as to maintain the rifled roller 80 pressed against the adjacent rifled roller 70 with a contact pressure which can be varied by adjusting the position of the counterweight 86.

Figure 4:
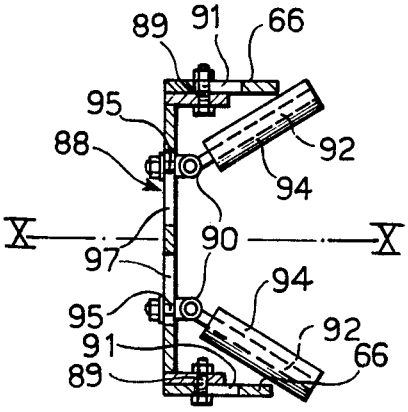
FIG. 4 is a section on line IV—IV of FIG. 1.

As shown in FIG. 4, in their lower region the walls 66 of the roller mount 64 support a crosspiece 88 by means of bolts 89 engaged in slots 91 in the walls 66. Due to this manner of support the crosspiece can be adjusted in position in a direction X-X perpendicular to the axis of the rifled rollers 70 and 80. In the central part of the crosspiece 88 there are pivotally mounted at 90 the ends of two pivot pins 92 on each of which is rotatably mounted a centring cylinder 94. The pivoted ends of the pins 92 are carried by elements 95 slidable in slots 97 in the crosspiece 88 whereby to allow the distance between the pins 92 to be adjusted.

The operation of the apparatus will now be described.

A length of textile coming from a treatment process such as dyeing, bleaching or washing, will generally be gathered together in the form of a rope and must be opened to its full width. The apparatus described above is designed to remove any twists which may have been introduced into the gathered textile during the course of its treatment.

After the angular position of the support arm 12 has been adjusted by means of the control wheel 18 so as to bring the mounting structure 24 into the most suitable position to receive a length of gathered and twisted textile T, the leading portion of the textile T is passed through the guide 44. In FIG. 1 two possible paths for the textile T through the guide 44 are shown, both in chain dashed lines. In one case the textile T is made to follow a sinuous path around one of the rollers 46, the other roller 46 serving solely to balance the first roller. In the second case the textile T is made to follow a sinuous S-shaped path around both rollers 46. In either case the textile T will be compelled to follow the rotation of the guide 44. The guide 44, which is rotatably supported by the rollers 56, and 60, is drivingly rotated by the roller 36 in a clockwise or anticlockwise sense in dependence on the current sense of rotation of the drive unit 38. Due to the frusto-conical form of the rollers 60 and the bush 52, the rollers 60 act as thrust-bearings to support the guide 44 axially when the mounting structure 24 is set in an inclined position as illustrated, for example, by the dotted line in FIG. 1. Owing to the fact that the support of the rotatable guide 44 is achieved without the use of roller bearings, there is no danger of the textile T becoming soiled in its passage through the guide 44 by grease which is always present in such bearings.

The textile T leaving the guide 44 passes around the pulley 62 between the rifled rollers 70, 80. Due to the possibility of adjusting the angular position of the roller mount 64 with respect to the fixed support structure 10, the roller mount 64 can be positioned such that the rifled rollers 70, 80 are symmetrically located with respect to a vertical plane parallel to the axes of these rollers and containing the textile T leaving the pulley 62. The centering cylinders 94 maintain the textile T in a central position with respect to roller mount 64 and the rifled roller 80. By suitable adjustment of the position of the crosspiece 88 and of the angle between the axes of the centering cylinders 94, the position of the centering cylinders 94 can be adapted to that of the rifled rollers 70, 80 located above.

As the textile T is drawn between the rifled rollers 70 and 80, the rifled roller 70 will undergo an axial displacement in a direction and by an amount which is dependent on the sense and degree of twisting of the textile T. When the axial displacement of the pin 68 carrying the rifled roller 70 is greater than a predetermined value in either direction (from its mid position) the corresponding proximity sensor 74 is activated to output a control signal to the motor unit 38 such as to cause the guide 44 to rotate in the direction appropriate to untwist the textile T. By varying the position of the counter-weight 86 on the arm 84, the sensitivity of the rifled rollers 70, 80 to the twisting of the textile can be adjusted in dependence on the type of textile T being untwisted.

The tubular sleeves 72 have a protective action in that they prevent the threads of the textile T passing into the zone between the walls 66 and the ends of the rifled roller 70 which would restrict the axial travel of the roller 70 and prevent activation of the proximity sensors 74.

I claim:

1. Improved apparatus for untwisting a textile length which has become gathered together and twisted into the form of a rope, said apparatus comprising:

a main support structure, a mounting structure carried by the support structure and angularly adjustable in position relative thereto, a guide having a textile entry and a textile exit which together define a main axis of guiding for a textile passed through said guide, means for mounting said guide in said mounting structure for rotation about its guiding axis, at least one elongate element carried by the guide and arranged to engage a said textile length extending through the guide between said textile entry and exit; said elongate element being disposed transversely to and spaced from the guiding axis of the guide whereby to cause said textile length to follow a sinuous path therethrough, drive means carried by the mounting structure and arranged to rotate the guide selectively in one or other sense of rotation, and means for detecting twist in the rope-form textile length, said twist-detecting means being disposed downstream of the guide and being connected to control the operation of said drive means, the twist-detecting means including a pair of rifled rollers arranged for mutual axial displacement and between which the rope-form textile is arranged to pass, twisting in said textile being effective to cause a mutual displacement of the two rollers in a direction dependent on the sense of twisting; wherein the improvement comprises the provision of said guide mounting means in the form of respective annular tracks provided on said guide about said textile entry and exits, said tracks being coaxial with said guiding axis, and respective pluralities of rollers mounted on said mounting structure in correspondence with said tracks, the rollers of each said plurality being rotatable about respective axes parallel to said guiding axis, and being spaced circumferentially around the corresponding said track in contact therewith, one said roller serving as a drive roller and being drivingly coupled to said drive means.

2. Apparatus according to claim 1, wherein each said plurality of rollers comprises a trio of rollers equiangularly spaced from each other around the corresponding track, one said trio of rollers and its corresponding track having cooperating cylindrical outer surfaces and the other said trio or rollers and its corresponding track having cooperating frusto-conical outer surfaces convergent away from the guide.

3. Apparatus according to claim 2, wherein said mounting structure includes two facing parallel walls, each defining an aperture, said guide having in correspondence with said textile entry and exit, respective tubular projections coaxial with said guiding axis and extending through respective ones of said wall apertures, each tubular projection comprising a bush the outer wall of which acts as the corresponding said annular track, and the said pluralities of rollers being carried by the said walls of the mounting structure.

4. Apparatus according to claim 1, wherein said drive roller is coated with a material having a high coefficient of friction.

5. Apparatus according to claim 1, wherein said guide is provided with two said elongate textile-engaging elements symmetrically disposed with respect to said guiding axis, each said elongate element being constituted by a roller rotatably mounted on a pivot pin carried by the guide in a manner enabling its position to be adjusted towards and away from the said guiding axis of the guide.

6. Apparatus according to claim 1, wherein said twist-detecting means includes a roller mount which is mounted for rotation but not axial displacement, the other said rifled roller being fixed on a pin which is rotatably and axially-displaceably mounted in said roller mount, and the twist-detecting means further including two proximity sensors arranged to detect displacement of said axially-displaceable pin in respective axial directions by an amount greater than a predetermined value from the mid-position of the associated rifled roller drive.

7. Apparatus according to claim 1, wherein the rifled rollers of the twist-detecting means are mounted in a roller mount which is carried by said fixed support structure such as to be angularly adjustable relative thereto whereby to allow the positioning of said rifled rollers symmetrically with respect to a vertical plane parallel to these rollers and containing the roped textile.

8. Apparatus according to claim 6 or claim 7, wherein the axially-displaceable rifled roller is carried by a pivot pin mounted in said roller mount and the other said rifled roller is carried by a rod pivoted on the roller mount about an axis parallel to the axes of the rifled rollers, said rod being provided with a projecting, adjustable counterweight.

9. Apparatus according to claim 8, wherein the roller mount is provided in the end zones of the axially-displaceable rifled roller, with respective tubular sleeves of greater diameter than the roller, the end edge portion of each sleeve being turned inwardly so as to extend close to the outer surface of the rifled roller.

10. Apparatus according to claim 6 or claim 7, wherein the roller mount carries downstream of said rifled rollers, a pair of centering cylinders which are rotatable about two axes inclined to each other in a plane perpendicular to the direction of advancement of the textile.

11. Apparatus according to claim 1, wherein two centering cylinders are carried by respective pivot pins which are themselves pivotally mounted such that their axes converge at an adjustable point.

12. Apparatus according to claim 11, wherein the pivot pins of the centering cylinders are pivoted at one end on a crosspiece mounted such as to be displaceable in a direction corresponding to the bisector of the angle between the said converging axes of the pivot pins.

* * * * *